US010301103B2

(12) United States Patent
Schulz et al.

(10) Patent No.: US 10,301,103 B2
(45) Date of Patent: May 28, 2019

(54) CONTAINER WITH SPRAY VALVE

(71) Applicant: Dow Global Technologies LLC, Midland, MI (US)

(72) Inventors: Peter J. Schulz, Midland, MI (US); Marc S. Black, Midland, MI (US); Matthew J. Turpin, Midland, MI (US); Jeffrey E. Bonekamp, Midland, MI (US); Todd A. Hogan, Midland, MI (US)

(73) Assignee: Dow Global Technologies LLC, Midland, MI (US)

( * ) Notice: Subject to any disclaimer, the term of this patent is extended or adjusted under 35 U.S.C. 154(b) by 23 days.

(21) Appl. No.: 15/886,441

(22) Filed: Feb. 1, 2018

(65) Prior Publication Data

US 2018/0155114 A1 Jun. 7, 2018

Related U.S. Application Data

(63) Continuation of application No. 15/084,860, filed on Mar. 30, 2016, now Pat. No. 9,908,689.

(51) Int. Cl.
*B65D 83/38* (2006.01)
*B65D 6/00* (2006.01)
(Continued)

(52) U.S. Cl.
CPC ..... *B65D 83/384* (2013.01); *B65D 11/10* (2013.01); *B65D 25/14* (2013.01);
(Continued)

(58) Field of Classification Search
CPC .. B65D 83/384; B65D 83/0055; B65D 83/48; B65D 83/0061; B65D 11/10;
(Continued)

(56) References Cited

U.S. PATENT DOCUMENTS 3,940,026 A 2/1976 Kain
4,324,350 A 4/1982 Thompson
(Continued)

FOREIGN PATENT DOCUMENTS

WO 2008/024097 A1 2/2008
WO 2012/117401 A1 9/2012
WO 2015/059681 A1 4/2015

*Primary Examiner* — Paul R Durand
*Assistant Examiner* — Andrew P Bainbridge
(74) *Attorney, Agent, or Firm* — Husch Blackwell LLP

(57) ABSTRACT

The present disclosure provides a dispenser for pressurized material. In an embodiment, the dispenser for pressurized material includes a container half having an exposed edge and a closure member at the exposed edge. The container half has a cup half in an interior top portion. The dispenser includes a reciprocal container half having a reciprocal exposed edge and a reciprocal closure member at the reciprocal exposed edge. The reciprocal container half has a reciprocal cup half in an interior top portion. The closure member and the reciprocal closure member matingly engage along the exposed edges to attach the container half to the reciprocal container half and form a container. The dispenser includes a sleeve bag on valve (SBoV) assembly in an interior of the container. The SBoV assembly includes a valve seat. The cup and the reciprocal cup support the valve seat to secure the SBoV assembly in the container.

10 Claims, 9 Drawing Sheets

(51) Int. Cl.

| | |
|---|---|
| ***B65D 47/20*** | (2006.01) |
| ***B65D 25/14*** | (2006.01) |
| ***B65D 83/48*** | (2006.01) |
| ***B65D 6/18*** | (2006.01) |
| ***B65D 1/02*** | (2006.01) |
| ***B65D 77/06*** | (2006.01) |
| ***B65D 83/00*** | (2006.01) |
| ***B65D 25/18*** | (2006.01) |
| *B05B 9/08* | (2006.01) |

(52) U.S. Cl.
CPC ..... *B65D 47/2018* (2013.01); *B65D 83/0055* (2013.01); *B65D 83/48* (2013.01); *B05B 9/0838* (2013.01); *B65D 1/0246* (2013.01); *B65D 11/1846* (2013.01); *B65D 25/18* (2013.01); *B65D 77/067* (2013.01); *B65D 83/0061* (2013.01)

(58) Field of Classification Search
CPC .... B65D 11/1846; B65D 25/14; B65D 25/18; B65D 47/2018; B65D 1/0246; B65D 77/067; B65D 11/20; H05K 999/99; B05B 9/0838
USPC ..... 222/95, 105, 182–184
See application file for complete search history.

(56) References Cited

U.S. PATENT DOCUMENTS

| | | | | |
|---|---|---|---|---|
| 4,387,833 | A | | 4/1983 | Venus, Jr. |
| 4,423,829 | A | | 1/1984 | Katz |
| 5,111,971 | A | | 5/1992 | Winer |
| 5,211,306 | A | | 5/1993 | Delonge-Immik et al. |
| 5,211,316 | A | | 5/1993 | Adalberto et al. |
| 5,474,212 | A | | 12/1995 | Ichikawa et al. |
| 5,927,551 | A | | 7/1999 | Taylor et al. |
| 6,070,763 | A | * | 6/2000 | Gueret ..... B05B 11/0024 222/105 |
| 6,142,344 | A | | 11/2000 | Kai |
| 6,510,965 | B1 | | 1/2003 | Decottignies et al. |
| 6,569,387 | B1 | | 5/2003 | Furner et al. |
| 6,997,353 | B2 | * | 2/2006 | Decottignies ..... B05B 11/046 222/105 |
| 7,121,431 | B2 | | 10/2006 | Duke |
| 7,686,193 | B1 | | 3/2010 | Gervais et al. |
| 7,815,075 | B2 | | 10/2010 | Simkins |
| 8,328,047 | B2 | | 12/2012 | Walters et al. |
| 8,464,908 | B1 | | 6/2013 | Tabor |
| 9,033,185 | B2 | | 5/2015 | Nimmo et al. |
| 9,908,689 | B2 | * | 3/2018 | Schulz ..... B65D 83/0055 |
| 2006/0138168 | A1 | | 6/2006 | Last et al. |
| 2007/0119875 | A1 | | 5/2007 | Ehret |
| 2009/0272761 | A1 | | 11/2009 | Cadden |
| 2010/0252573 | A1 | | 10/2010 | Hetmaniok et al. |
| 2011/0139300 | A1 | | 6/2011 | Tanaka et al. |
| 2012/0168461 | A1 | | 7/2012 | Topits et al. |
| 2013/0341354 | A1 | | 12/2013 | Archer |
| 2013/0345647 | A1 | | 12/2013 | Har-Shai |
| 2014/0231452 | A1 | | 8/2014 | James et al. |
| 2014/0252032 | A1 | | 9/2014 | Corbett et al. |
| 2015/0083755 | A1 | | 3/2015 | Meeker et al. |
| 2015/0158042 | A1 | | 6/2015 | Parker |
| 2017/0189627 | A1 | | 7/2017 | Klever et al. |

* cited by examiner

CONTAINER WITH SPRAY VALVE

BACKGROUND

The present disclosure is directed to a dispenser for pressurized material and a dispenser for propellant-free pressurized material in particular.

Known are sleeve bag on valve (SBoV) dispensing systems that utilize an elastic sleeve disposed around a fluid-filled inner bag. Actuation of the valve releases pressure and the elastic sleeve contracts expelling the fluid contents from the bag without a propellant. A drawback of conventional SBoV systems is the need for an outer support container. Conventional SBoV support containers typically top-load the empty SBoV through the neck of a container and subsequently secure the SBoV to the container neck. Conventional support containers are typically metal with the valve seat of the SBoV assembly attached by way of crimping, threaded screws, or welded to the top opening of the container. Once secured to the neck, the sleeve-on-bag portion of the SBoV hangs freely from the neck and into the container interior. The SBoV is then filled under pressure through the valve with fluid composition.

The art recognizes the need for alternate ways to secure the SBoV assembly to the support container, and, in particular, SBoV installment that avoids insertion through the top opening of the support container.

SUMMARY

The present disclosure provides a dispenser for pressurized material. In an embodiment, the dispenser for pressurized material includes a container half having an exposed edge and a closure member at the exposed edge. The container half has a cup half in an interior top portion. The dispenser includes a reciprocal container half having a reciprocal exposed edge and a reciprocal closure member at the reciprocal exposed edge. The reciprocal container half has a reciprocal cup half in an interior top portion. The closure member and the reciprocal closure member matingly engage along the exposed edges to attach the container half to the reciprocal container half and form a container. The dispenser includes a sleeve bag on valve (SBoV) assembly in an interior of the container. The SBoV assembly includes a valve seat. The cup and the reciprocal cup support the valve seat to secure the SBoV assembly in the container.

The present disclosure provides another dispenser for pressurized material. In an embodiment, the dispenser for pressurized material includes a container half having an exposed edge and a closure member at the exposed edge. The container half includes a cup half in an interior top portion. The dispenser includes a reciprocal container half having a reciprocal exposed edge and a reciprocal closure member at the reciprocal exposed edge. The reciprocal container half includes a reciprocal cup half in an interior top portion. The closure member and the reciprocal closure member matingly engage along the exposed edges, attaching the container half to the reciprocal container half to form a container. The dispenser includes an SBoV assembly in an interior of the container. The SBoV assembly includes a valve extending from the top portion of the container. The dispenser includes a valve cap that has a first leg flexibly attached to the container half and a second leg flexibly attached to the reciprocal container half, the valve cap in fluid communication with the valve.

The present disclosure provides a process. In an embodiment, the process includes providing a container half having an exposed edge and a closure member at the exposed edge. The container half has a cup half in an interior top portion. The process includes providing a reciprocal container half having a reciprocal exposed edge and a reciprocal closure member at the reciprocal exposed edge. The reciprocal container half has a reciprocal cup half in an interior top portion. The process includes inserting a sleeve bag on valve assembly in an interior of the container half. The process includes joining, with the closure members, the container halves along the exposed edge, and forming a container with the SBoV in the container interior.

An advantage of the present disclosure is a SBoV support container formed from two container halves along a longitudinal axis.

An advantage of the present disclosure is a SBoV support container made of a moldable polymeric material that can be formed into a variety of consumer-appealing shapes and configurations for SBoV support.

An advantage of the present disclosure is a container for dispensing a fluid material under pressure and with no propellant. The spray system of the present disclosure can deliver a propellant-free aerosol spray of product, such as a liquid material.

DETAILED DESCRIPTION

Figure 1:
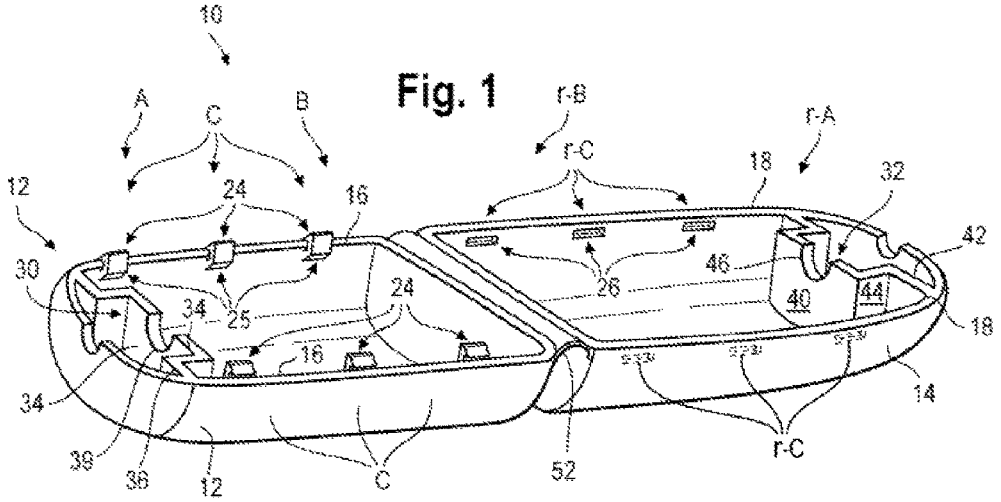
FIG. 1 is perspective view of a container half and a reciprocal container half in accordance with an embodiment of the present disclosure.

The present disclosure provides a device. In an embodiment, the device is a dispenser for pressurized material. The dispenser includes a container half having an exposed edge and a closure member at the exposed edge. The container half has a cup half in an interior top portion of the container half. The dispenser includes a reciprocal container half having a reciprocal exposed edge and a reciprocal closure member at the reciprocal exposed edge. The reciprocal container has a reciprocal cup half in an interior top portion of the reciprocal container half. The closure member and the reciprocal closure member matingly engage along the exposed edges to attach the container half to the reciprocal container half and form a container. A sleeve bag on valve assembly (SBoV) is located in an interior of the container. The SBoV assembly includes a valve seat. The cup and the reciprocal cup support the valve seat to secure the SBoV assembly in the container.

1. Container Halves

As shown in FIGS. 1-5, a dispenser 10 includes a container half 12 and a reciprocal container half 14 (hereafter "r-container half"). Container half 12 has an exposed edge 16 and r-container half 14 has a reciprocal exposed edge 18 (hereafter "r-exposed edge"). The container half 12 and r-container half 14 may be collectively referred to as "container halves" or "halves." Similarly, the exposed edge 16 and the r-exposed edge 18 may be collectively referred to as "exposed edges," or "edges."

The halves 12, 14 are composed of a rigid material or a semi-rigid material. In an embodiment, the halves 12, 14 are composed of a rigid material. The material for half 12 may be the same or different than the material for half 14. Nonlimiting examples of suitable material for halves 12, 14 includes polymeric material, metal, wood, glass, paperboard (such as cardboard), and any combination thereof.

In an embodiment, each half 12, 14 is composed of a polymeric material. Nonlimiting examples of suitable polymeric material include olefin-based polymer, nylon (polyamide), polyethylene terephthalate (PET), polyurethane, polycarbonate, polyacrylate, polymethacrylate, cyclic olefin copolymers ("COC", such as TOPAS or APEL), polyesters (crystalline and amorphous), copolyester resin (such as polyethylene terephthalate glycol-modified "PETG"), cellulose esters (such as polylactic acid or "PLA"), styrene acrylonitrile resin (SAN), acrylonitrile butadiene styrene (ABS), polystyrene, high impact polystyrene (HIPS) and combinations thereof. Fillers, colorants or pigments, stabilizers, mold release agents, etc. as well as reinforcement aids such as glass fibers could also be added to the polymeric material for additional properties.

In an embodiment, each half 12, 14 is an olefin-based polymer. Nonlimiting examples of suitable olefin-based polymer include propylene-based polymer and ethylene-based polymer.

Nonlimiting examples of suitable propylene-based polymer include propylene-based polymer (including plastomer and elastomer), random propylene copolymer, propylene homopolymer, and propylene impact copolymer, blends of propylene-based polymer with other olefin-based polymer such as blends with ethylene-based polymer, polyethylene elastomer, and thermoplastic olefin (TPO).

Nonlimiting examples of suitable ethylene-based polymer include ethylene/$C_3$-$C_{10}$ α-olefin copolymers (linear or branched), ethylene/$C_4$-$C_{10}$ α-olefin copolymers (linear or branched), high density polyethylene ("HDPE"), low density polyethylene ("LDPE"), linear low density polyethylene ("LLDPE"), or medium density polyethylene ("MDPE"). In an embodiment, the ethylene-based polymer is a HDPE having a density of at least 0.94 g/cc, or from at least 0.94 g/cc to 0.98 g/cc and a melt index from 0.1 g/10 min to 25 g/10 min The polymeric material may be a single layer or structure, or a multilayer structure. When the polymeric material is a multilayer structure, the multilayer structure may be coextruded or laminated. Suitable processes to make the halves include thermoforming or injection molding. Injection molding can be multi-component injection molding and include bi-injection molding, co-injection molding, multi-shot injection molding, and/or insert-molding or over-molding could be used to make each half. The polymeric material may be biaxially oriented or monoaxially oriented.

Nonlimiting examples of suitable structures include co-injected mold halves with multilayer structure with a stiffer inner material inside (such as fiber reinforced polymeric material) with outer layer composed of a tough/ductile material such as elastomer for high impact resistance; co-injection of smooth outside layer over foamed plastic core; over-molded injection molded halves (such as to add TPE soft touch grips, or decoration in some or all areas on the halves). In-mold labels could also be added in the process to make the halves.

In an embodiment, the halves 12 and 14 have chemical resistance to the fluid composition that is dispensed.

In an embodiment, the halves 12, 14 are composed of the same polymeric material. Nonlimiting examples for halves 12, 14 of the same polymeric material include HDPE, such as DOW™ HDPE DMDA 8007 NT 7 (8.3 MI, 0.965 g/cc); UNIVAL™ DMDA 6400 NT 7 HDPE (0.80 g/10 min, 0.961 g/cc); ethylene/hexene copolymer such as UNIVAL™ DMDA 6200 NT 7 HDPE (0.38 g/10 min, 0.953 g/cc) for either thermoforming or blow molding processes.

In an embodiment, each half 12, 14 has a respective thickness T (T for half 12, r-T for half 14). The average wall thickness for each half 12, 14 average wall thickness is 0.075 mm, or 0.1 mm, or 0.15 mm, or 0.2 mm, or 0.4 mm, or 0.6 mm to 1.0 mm, or 1.5 mm, or 2 mm, or 3.0 mm.

As seen in FIG. 1, each half 12, 14 has a depth and forms a partial cavity. The halves 12, 14 are fabricated, or otherwise are configured, to cooperatively engage with each other to form a whole container. It will be appreciated that when the halves 12, 14 are brought together so that the edge 16 and r-edge 18 reciprocally engage to contact each other, the halves 12 and 14 cooperate to form a container with a closed interior, such as an interior chamber. The interior chamber is configured to contain, or otherwise support, an SBoV as will be discussed below.

The shape of the container when closed can be cylindrical or rectilinear. The container may have a contour or a non-regular shape, such as a stylized shape or a tailored shape.

In FIG. 1, closure members C are located along the exposed edge 16 and reciprocal closure members r-C (hereafter "r-closure member") are located along the r-exposed edge 18. Closure member and r-closure member collectively may be referred to as "closure members." FIG. 1 shows multiple closure members C disposed along exposed edge 16 in a space-apart manner with reciprocal closure members r-C spaced-apart along r-exposed edge 18 in a similar space-apart manner. Closure members C/r-C can be permanent closures or releasable closures. Each closure member C on exposed edge 16, has a corresponding reciprocal closure member r-C along r-exposed edge 18. Each closure member, C, and respective reciprocal closure member, r-C, is positioned to mate, or otherwise to engage cooperatively, when the halves 12, 14 are brought together in a joining process, described below.

Although FIG. 1 shows three closure members C (each with a respective reciprocal closure member r-C), it is understood that half 12 can have from 1, or 2, or 3, or 4, to 5, of 6, or 7, or 8, or 9, or 10, or more closure members (each with a respective r-closure member on half 14).

Nonlimiting examples of suitable closure/r-closure members for dispenser 10 include snap fit, annular snap joint (two rotationally symmetric parts), hinge-closure, male-female closure, hook and mount, friction fit, and combinations thereof. In addition, the closure/r-closure members may be further attached to each other by way of adhesive material, vibration welding, heat staking, or stir welding, and combinations thereof.

In an embodiment, the closure members C, r-C cooperatively engage to mate and form a snap fit joint. As shown in FIG. 1, closure member C includes a protruding member 20 with a hook 24, r-closure member, r-C, includes a retaining member 26 having a hole 28 as shown in FIG. 2.

As shown in FIG. 1, each container half 12, 14 has a top portion A (half 12), r-A (r-half 14) and a bottom portion B (half 12) and r-B (r-half 14). Half 12 includes a cup 30 in top portion A and r-half 14 includes a reciprocal cup 32 (hereafter "r-cup") in top portion r-A. The cup and r-cup collectively may be referred to as "cups."

2. Sleeve and Bag on Valve Assembly

The dispenser 10 includes a sleeve and bag on valve assembly (or "SBoV") 100, as shown in FIGS. 2A, 2B, 2C, and 3. The terms "SBoV" and "SBoV assembly" may be used interchangeably. Best shown in FIG. 3B, the SBoV 100 includes a valve housing 102, a valve seat 104, a lip portion 105, an optional core tube 106, a bag 108, and an elastic sleeve 110.

Figure 3:
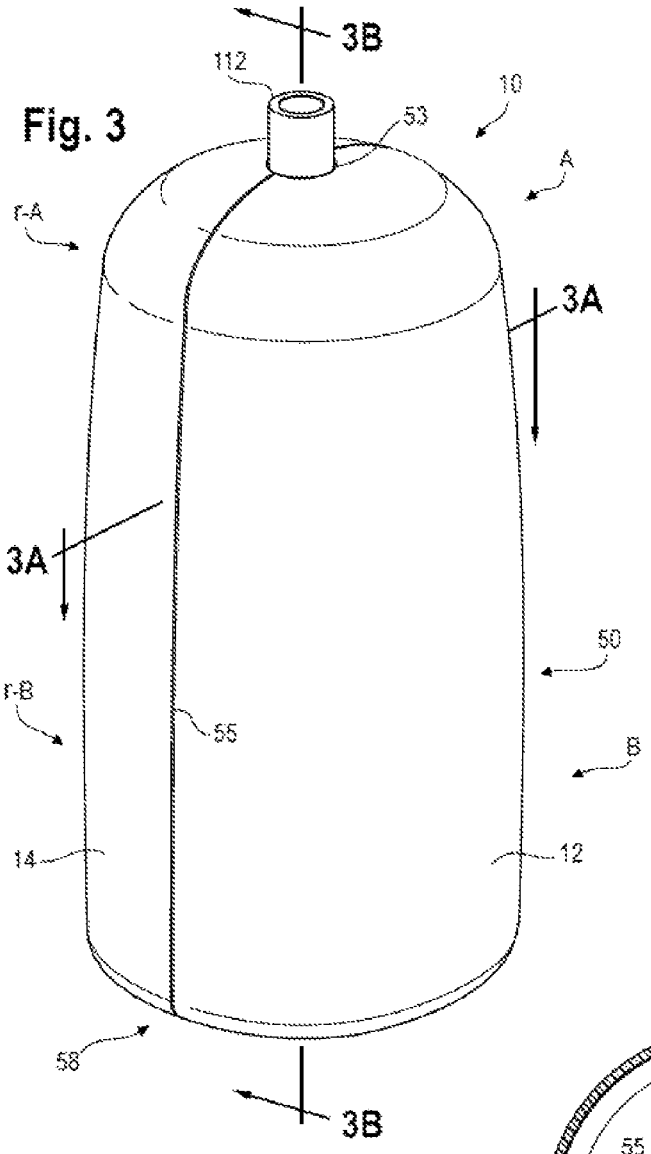
FIG. 3 is a perspective view of the container half and the reciprocal container half joined to form a container holding the SBoV in accordance with an embodiment of the present disclosure.
Figure 3A:
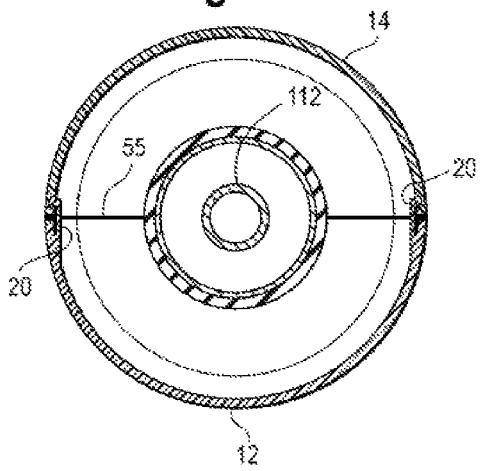
FIG. 3A is a sectional view taken along line 3A-3A of FIG. 3.
Figure 3B:
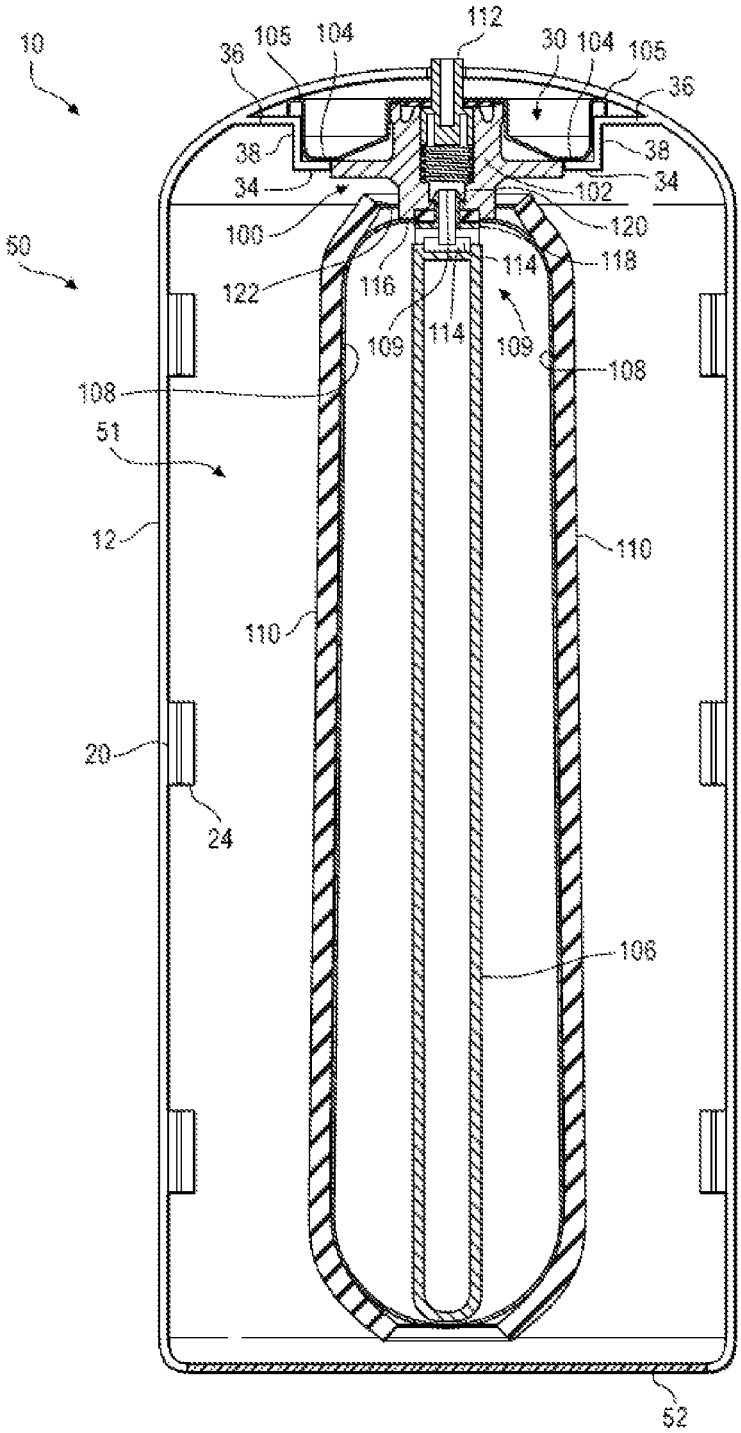
FIG. 3B is a sectional view taken along line 3B-3B of FIG. 3.

The valve housing 102 is configured to hold a valve 112, as shown FIG. 3B. FIG. 3B shows a nonlimiting example of a spring valve. The valve housing 102 is securely attached to the valve seat 104. Secure attachment between the valve housing 102 and the valve seat 104 can occur by way of (i) crimping the valve seat 104 onto the valve housing 102, (ii) adhesive attachment between the valve housing 102 and the valve seat b 104, and (iii) a combination of (i) and (ii).

The valve seat 104 is composed of a rigid material. Nonlimiting examples of suitable material for the valve seat 104 include metal (steel, aluminum) and polymeric material.

The lip portion 105 is composed of a rigid material. Nonlimiting examples of suitable material for the lip portion 105 include metal (steel, aluminum) and polymeric material.

The SBoV 100 may or may not include the core tube 106. In an embodiment, the SBoV 100 does not have the core tube.

In an embodiment, the SBoV includes core tube 106. As shown in FIG. 3B, the core tube 106 is present in the interior of the bag 108, with the bag 108 surrounding the core tube 108. The bag 108 is a flexible film structure composed of a polymeric material. The bag 108 can be a single layer flexible film or a multilayer flexible film. Nonlimiting examples of suitable polymeric material for the bag 108 includes propylene-based polymer, ethylene-based polymer, and combinations thereof.

In an embodiment, the SBoV includes core tube 106. As shown in FIG. 3B, the core tube 106 is present in the interior of the bag 108, with the bag 108 surrounding the core tube 106. The bag 108 is a flexible film structure composed of a polymeric material. The bag 108 can be a single layer flexible film or a multilayer flexible film. Nonlimiting examples of suitable polymeric material for the bag 108 includes propylene-based polymer, ethylene-based polymer, and combinations thereof. The bag 108 may include a barrier layer such as a metal foil film. The barrier layer may be laminated to the flexible film. The bag interior wall and other SBoV components exposed to the fluid composition may have chemical resistance to the fluid composition.

In an embodiment, the bag 108 is a multilayer film having a thickness from 100 micrometers (μm), or 200 μm to 225 μm, or 250 μm and the multilayer film is chemically resistant and a barrier to the fluid composition it contains. In a further embodiment the bag 108 is a multilayer film and includes an oxygen barrier layer, a carbon dioxide barrier layer, a water barrier layer, and combinations thereof.

The core tube 106 can be hollow or can be solid. The core tube 106 can be fluted, pleated or channeled axially to promote movement of product into and through the port 114.

The core tube 106 can be composed of propylene-based polymer or ethylene-based polymer such as HDPE. Alternatively, the core tube 106 can be composed of an amorphous polyester such as PETG, polyamide or other suitable engineering thermoplastic.

In an embodiment, the core tube 106 is composed of a non-crushable material up to 8 to 20 bar or more.

The core tube 106 can have a uniform diameter along its length. Alternatively, the core tube 106 can be tapered. In an embodiment, the core tube 106 is tapered and the diameter of the core tube 106 gradually increases, moving from the proximate end (or top end) of the core tube to the distal end of the core tube. The distal end of the core tube may be rounded to help maintain integrity of bag 106 of the support container for SBoV 100 is dropped.

The core tube 106 can be integral to, or can be a separate component attached to, the valve housing 102. In an embodiment, the core tube 106 is a component separate from the valve housing 102 and the core tube 106 is hollow. A hollow top end 109 of the core tube 106 extends through the opening of the bag 108 as shown in FIG. 3. The core tube 106 includes a port 114 and a port head 118. The port 114 is below the hollow top end 109 and in fluid communication with the hollow top end 109. The open end of the bag 108 is placed between a gasket 116 and the port head 118. The hollow top end 109 attaches to a valve channel 120 on the underside of the valve housing 102 to place the port 114 in fluid communication with the valve 112. The gasket 116 sandwiches the bag opening between the port head 118 and the valve housing 102 to hermetically close, or otherwise securely seal, the bag 108 to the valve housing 102.

In a further embodiment, the secure attachment between the top end 109 and the valve channel 120 is by way of a fixed and secure snap fit. Materials of construction for the top end 109 can be different than for the core tube 106. For example, INFUSE™ ethylene/alpha-olefin multi-block copolymer may be used. Also, in an embodiment, the bag 108 can be heat sealed to the top end 109 to provide hermetic seal and then secured into the valve channel 120.

The sleeve 110 is a tube-like structure made of an elastomeric material. An "elastomeric material," as used herein, is a material that can be stretched with the application of stress to at least twice its length and after release of the stress, returns to its approximate original dimensions and shape showing good recovery. The elastomeric material may, or may not, be a vulcanized or cross-linked or grafted material.

In an embodiment, the elastomeric material is vulcanized.

In an embodiment, the elastomeric material has a linear modulus vs elongation relationship. The elastomeric material exhibits a small amount of creep or stress relaxation sufficient to provide a cup life from 3 months, or six months to 1 year for the fluid composition.

Nonlimiting examples of suitable elastomeric material include ethylene copolymers (like ENGAGE™), ethylene olefin block copolymers (like INFUSE™), ethylene propylene diene monomer terpolymer (EPDM such as NORDEL™ EPDM polymers), ethylene propylene (EPM), nitrile rubber, hydrogenated nitrile butadiene rubber (HNBR), polyacrylic rubber, silicone rubber, fluorosilicone rubber, fluoroelastomers, perfluoro rubber, natural rubber (i.e., natural polyisoprene), synthetic polyisoprene, chloropene, polychloroprene, neoprene, halogenated or non-halogenated butyl rubber (copolymer of isobutylene and isoprene), styrene-butadiene rubber, epichlorohydrin, polyether block amides, chlorosulfonated polyethylene, and any combination of the foregoing. Elastomer additives known in the art to be provide benefit such as antioxidant and processing stabilizers, antiblocks, vulcanization agents (typically sulfur), crosslink agents such as peroxides, accelerators, activators, and optionally dispersants, processing aids, plasticizers, and fillers including organoclays and nanoclays, carbon black, etc. can be included in the elastomer composition.

In an embodiment, the elastomeric material comprises nano-sized organoclays or nanoclays and as such in an elastomeric composite or elastomeric nanocomposite, for example.

The sleeve 110 can expand (and contract), or otherwise elongate, in a radial direction and an axial direction.

In an embodiment, the sleeve 110 expands and contracts in the radial direction.

The sleeve 110 is sized and shaped to contain the bag 108 and to exert pressure on bag 108 when the bag 108 is filled with fluid composition (or fluid product) to be dispensed. The sleeve 110 may or may not have a uniform thickness. The sleeve 110 may or may not impart uniform pressure during the discharge cycle of fluid composition from the bag 108.

In an embodiment, the sleeve 110 provides even pressure during the entire dispensing cycle (bag filled with fluid composition to bag emptied of fluid composition). The sleeve 110 also provides positive pressure on the bag after dispensing ensuring complete discharge of all, or substantially all, fluid composition from the bag 108. The sleeve 110 may or may not be open on top and bottom. The elastic sleeve 110 may be longer than the bag 108 to ensure emptying of all the contents in bag 108.

The sleeve 110 is thick enough to apply a force that is sufficient to expel product from the bag 108 and through the valve 112. The valve stem may also have an actuator on it that controls the type of spray pattern and flow rate desired for the product.

When the valve 112 is actuated, the sleeve 110 uniformly contracts to push fluid composition from the bag 108, through the port 114 and out through the valve 112. In an embodiment, the sleeve 110 has a thickness when unexpanded, or otherwise unstretched, and denoted as "sleeve wall thickness." The sleeve wall thickness is from about 1.5 mm, or 2.0 mm, or 3.0 mm, or 5.0 mm, or 7.0 mm to 10.0 mm, or 15.0 mm, or 20.0 mm.

In an embodiment, the sleeve 110 is made of an elastomeric material that has an elongation from greater than 200%, or 250%, or 300% to 400%, or 500%, or 550%, or 600%, or 700%.

In an embodiment, the elastomeric material has a tensile modulus at 200% elongation of at least 2 mega pascals (MPa), or 3 MPa, or 5 Mpa to 8 Mpa, or 10 Mpa, or 12 Mpa, or 14 MPa or higher.

In an embodiment, the sleeve 110 is extended (stretched) to from 300% elongation, or 400% elongation to 500% elongation. In an embodiment, the elastomeric material can have a modulus that is 20 MPa or higher at 400% elongation. The sleeve 110 may also exhibit a relaxation lower than 25% change in tensile modulus at 200% elongation within one year and/or an average creep rate lower than 4 mm/day.

In an embodiment, a clip 122 secures the sleeve 110 to the valve housing 102 as shown in FIG. 3B.

In an embodiment, the minimum diameter of the core tube 106 encircled by the empty bag 108 combined (SBoV) is greater than the diameter of the unstretched sleeve 110. With this configuration, the sleeve 110 provides constant positive pressure onto the bag 108 ensuring uniform distribution of the product from the bag until full and complete expulsion of all, or substantially all, product (fluid composition) from the bag 108.

In an embodiment, the core tube 106 and empty bag 108 (the SBoV) have a combined minimum diameter that is from 10%, or 15%, or 20% to 25%, or 30%, or 40%, or even 50% greater than the diameter of the unexpanded sleeve 110. In this way, the sleeve 110 applies constant positive pressure upon the bag 108.

In an embodiment, the sleeve is longer than the bag on core/valve to ensure positive pressure is exerted on the bottom end of the bag sufficient to expel product at the bottom of the bag up and through the port 114 and through the valve 112.

The fluid composition (for dispensing from the bag 108) is a substance that is fluidly deliverable when dispensed under compressive pressure by the sleeve 110, the fluid composition flowing out of the bag 108 under pressure when the valve 112 is opened. The fluid composition can be a liquid, a paste, a foam, a powder, or any combination thereof. Nonlimiting examples of suitable fluid compositions include:

food products, such as mayonnaise, ketchup, mustard, sauces, desserts (whipped cream), spreads, oil, pastry components, grease, butter, margarine, sauces, baby food, salad dressing, condiments, beverages, syrup;

personal care products such as cosmetics creams, toothpaste, lotions, skin care products, hair gels, personal care gel, liquid soap, liquid shampoo, sun care products, shaving cream, deodorant;

medicaments, pharmaceutical and medical products such as medications (including dosage packages) and ointments, oral and nasal sprays;

household products such as polishes and glass, bathroom and furniture and other cleaners, insecticides, air fresheners; and industrial products such as paints, lacquers, glues, grease and other lubricants, oil sealants, pastes, chemicals, insecticides, herbicides, and fire extinguishing components.

3. Fabrication of Container

Figure 2A:
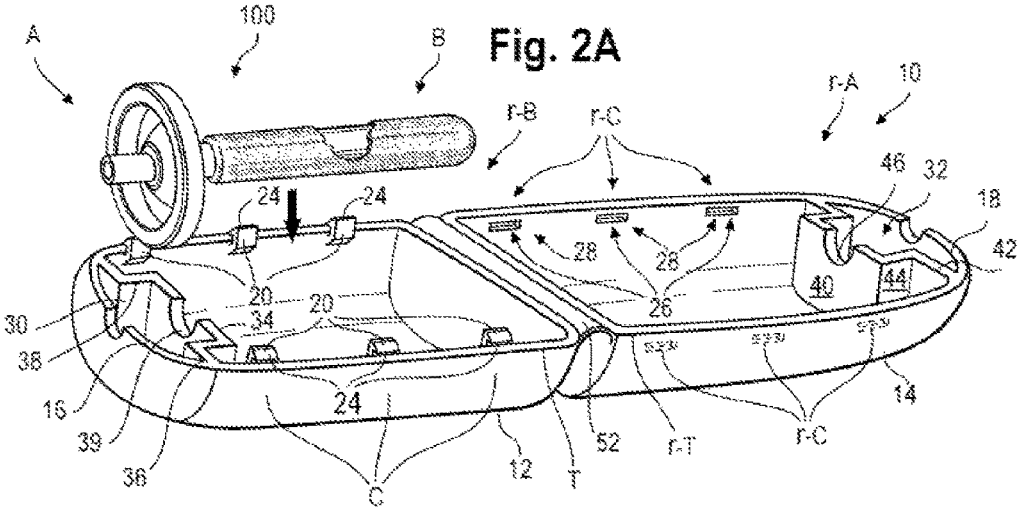
FIG. 2A is a perspective view of a sleeve bag on valve assembly (SBoV) being inserted into a container half in accordance with an embodiment of the present disclosure.
Figure 2B:
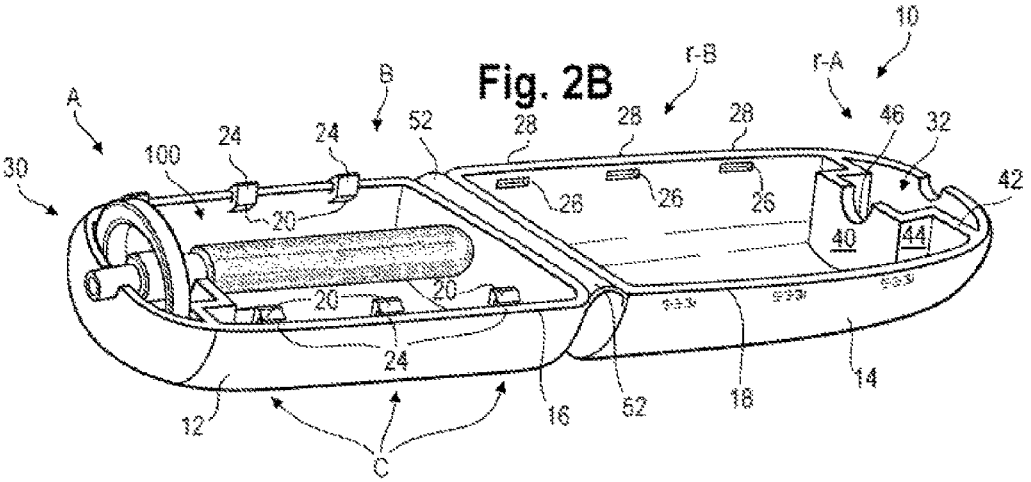
FIG. 2B is a perspective view of the SBoV assembly inserted into the container half in accordance with an embodiment of the present disclosure.
Figure 2C:
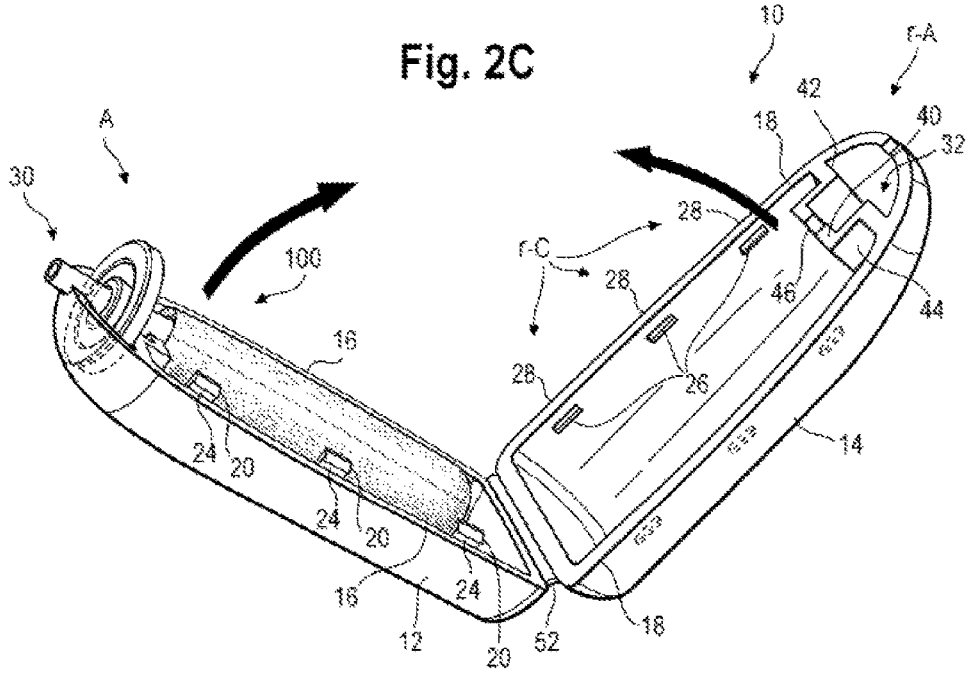
FIG. 2C is a perspective view of the container half, with the SBoV assembly inserted therein, joining the reciprocal container half.

As shown in FIGS. 2A and 2B, the SBoV 100 is inserted into the cup 30 that is located in half 12. The cup 30 includes a base 34, a shelf 36, and a wall 38 extending between the base 34 and the shelf 38. Similarly r-cup 32 includes a reciprocal base 40 ("r-base"), a reciprocal shelf 42 ("r-shelf"), and a reciprocal wall 44 ("r-wall"). The valve seat 104 is inserted into the cup 30 between the base 34 and the shelf 36. The lip portion 105 is inserted onto the shelf 36. Insertion stops when the lip portion 105 abuts, or otherwise contacts, the inner surface of the half 12 at upper portion A. The base of cup 30 has a half collar 39 (r-cup 32 has r-half collar 46) through which a portion of the valve housing 102 extends. As shown in FIGS. 2A, 2B, and 2C, the cup 30 supports half the diameter of the valve seat 104 with the core tube 106, bag 108, and sleeve 110 extending freely below the base 34.

In an embodiment, the base/r-base 34,40 are eliminated and the valve lip 105 is supported by the shelf/r-shelf 36,42.

r-Half 14 is joined to half 12 by bringing the r-exposed edge 18 into cooperative contact and placement with exposed edge 16. As the edges 16 and 18 approach each other, the hook 24 comes into contact with the inner surface of r-half, causing the protruding member 20 to flex, or otherwise deflect, radially inward.

Each hook 24 continues along the inner surface of the r-half 14 until the hook 24 mates with its respective retaining member 26 by snapping into the hole 28 of its respective retaining member 26. The hook 24 snaps into the hole 28, bringing exposed edges 16, 18 into full and complete engagement, or contact, with each other. The protruding member 20 is deflected briefly during the joining operation. Once the hook 24 mates with its respective retaining member 26, the protruding member 20 returns to a stress-free condition as shown in FIG. 3A.

In an embodiment, an adhesive material is applied the exposed edge 16 and r-exposed edge 18 to promote attachment there between.

Figure 4:
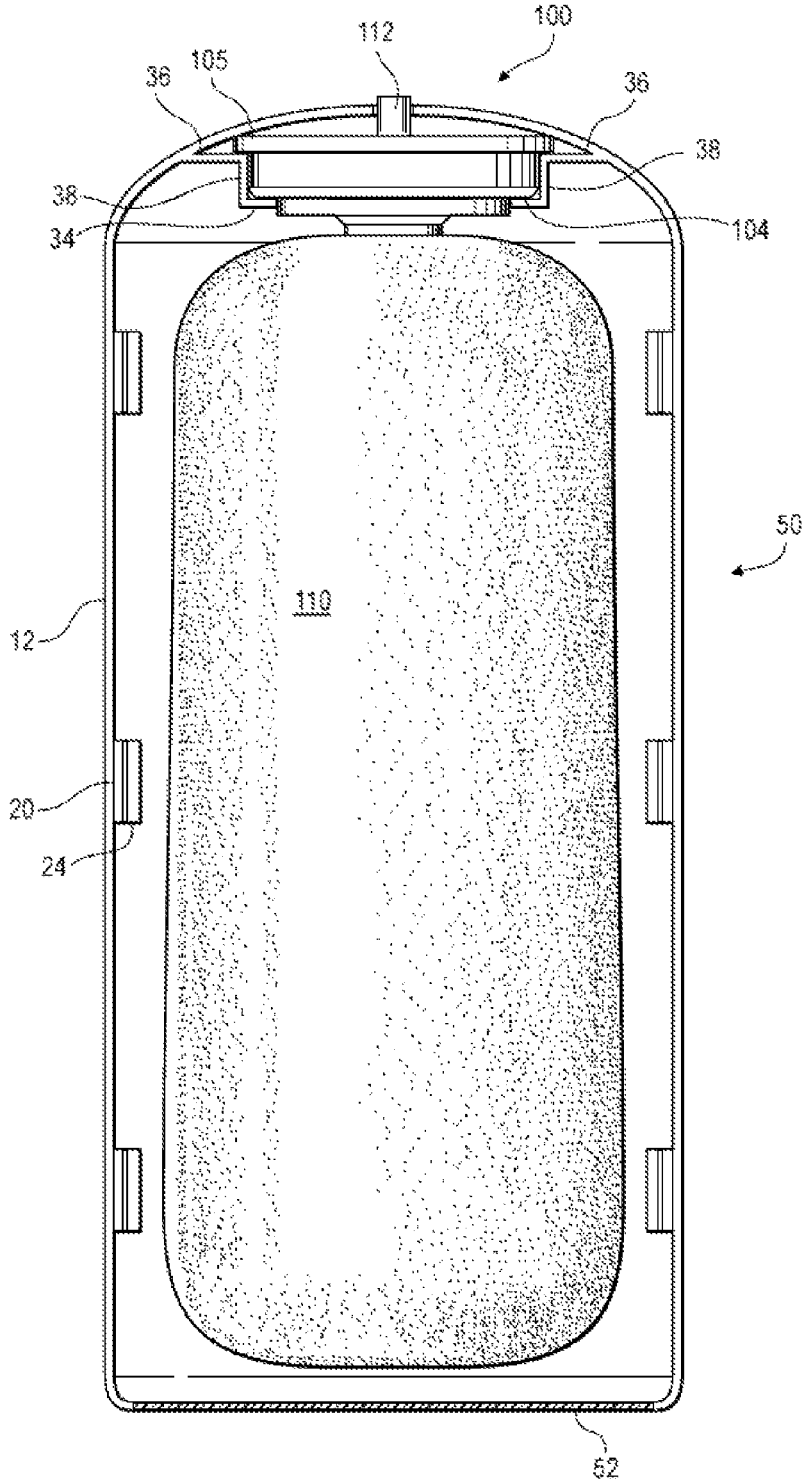
FIG. 4 is a sectional view taken along line 3B-3B of the container holding a filled SBoV in accordance an embodiment of the present disclosure.
Figure 5:
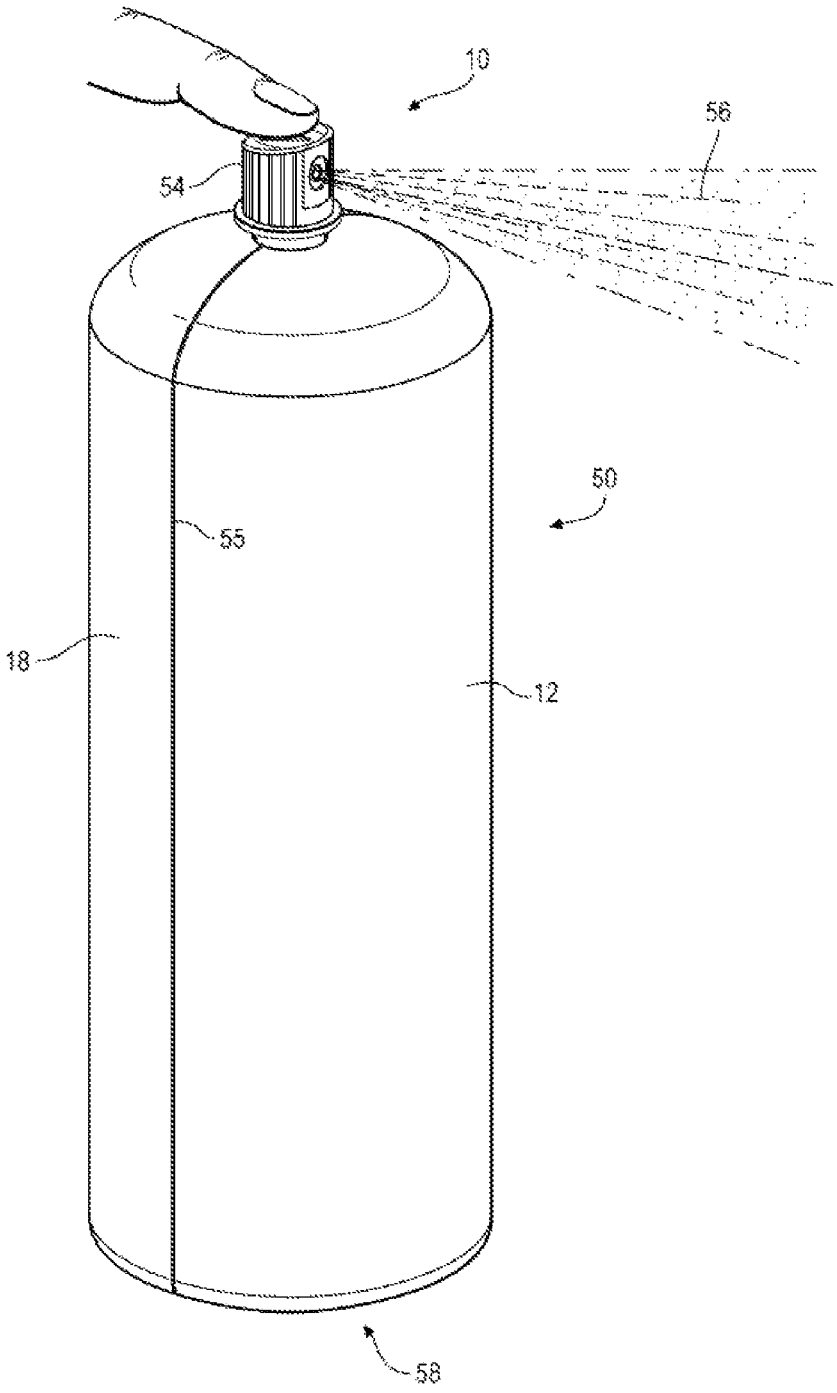
FIG. 5 is a perspective view of a container holding a SBoV assembly and dispensing a fluid composition in accordance with an embodiment of the present disclosure.

With the joining procedure complete, container 50, with SBoV 100, disposed therein, is formed as shown in FIGS. 3-5. Container 50 includes an interior chamber 51 in which the core tube 106, bag 108, and sleeve 110 hang freely from the cup/r-cup 30, 32. Interior chamber 51 provides sufficient volume to accommodate a filled, or partially filled, bag 108.

With container 50 formed, the base of cups 16, 18 support the entire circumference of the valve seat 104. Similarly, the shelves 36, 44 of respective cups 16, 18 support the entire circumference of the lip portion 105.

In this way, closures C and reciprocal closures r-C secure the halves 12, 14 to each other to form a whole container, i.e., container 50, in which the SBoV 100 is securely stationed.

Each half 12, 14 has a half eye, which upon formation of the container 50, cooperate to create a full eye 53 through which the valve 112 extends exteriorly outward from the top portion of the container 50 as shown in FIG. 3.

Container half 16 can receive an empty SBoV, a partially full SBoV or a full SBoV. FIG. 4 demonstrates the SBoV 100 after the bag 108 has been filled with a fluid composition. FIG. 4 shows sleeve 110 stretched with the bag 108 holding a fluid composition and sleeve 110 applying the pressure.

The exposed edges 16, 18 (FIGS. 2A-2C) form a seam 55 in container 50. The seam 55 extends along a longitudinal axis of the container 50. In an embodiment, the present flexible container 50 maintains its shape, not collapsing or changing dimensions or appearance as the fluid composition is expelled from the bag (creating internal vacuum).

In an embodiment, a valve cap 54 is attached to the valve 112 as shown in FIG. 5. Valve cap 54 (FIG. 5) enables a user of the container 50 to actuate the valve 112 and to direct the spray (as well as determine the spray pattern and/or determine the spray flow rate) of the fluid composition 56 in a desired direction.

In an embodiment, the interior chamber 51 has a volume from 0.050 liter (L), or 0.1 L, or 0.2 L, or 0.3 L, or 0.4 L, or 0.5 L, or 0.6 L, or 0.75 L, or 1.0 L, or 1.5 L, or 2.5 L, or 3.0 L, or 3.5 L, or 4.0 L, or 5.0 L, or 10.0 L to 20.0 L, or 25 L, or 28.5 L. In a further embodiment, the volume of the filled bag 108 is from 5%, or 10%, or 15% to 20%, or 25%, or 30% less than the volume of the container 50.

FIG. 5 shows bottom segment 58 supporting the container 50 during discharge of a fluid composition 56. The halves 12, 14 provide sufficient strength and rigidity to maintain, or otherwise hold, SBoV 100 and container 50, in a vertical position, or in a substantially vertical position. Therefore, in an embodiment, the container 50 is "a stand-up container."

After complete, or substantially complete, discharge of the fluid composition, the bag 108 can be re-filled with fluid composition through the valve 112. In an embodiment, the SBoV 100 of dispenser 10 can be refilled one time, or two times, or three times, to four times, or five times or more.

The valve 112 can also have various types of actuators or spray caps fastened to it in order to deliver product in the desired manner including but not limited to fluid stream, gel, lotion, cream, foam, fluid spray, or mist.

4. Hinge

In an embodiment, a hinge 52 is located along a portion of each exposed edge 16 18 as shown in FIGS. 1-2C. The hinge 52 is composed of a flexible polymeric material and connects, or otherwise attaches, half 12 to r-half 14 as shown in FIG. 1. In an embodiment each of half 12, r-half 14, and hinge 52 are composed of the same polymeric material.

Half 12, r-half 14 and hinge 52 may or may not be an integral component. In an embodiment, half 12, r-half 14, and hinge 52 are elements of a single integral component.

Although FIG. 1 shows hinge 52 located along a bottom portion of each half 12, 14, it is understood that one or more hinges may be present along other portions of exposed edges 16, 18.

Hinge 52 enables flexible movement between halves 12, 14. Hinge 52 contributes with alignment during the assembly of the container 50. Upon fabrication of the container 50, the hinge 52 forms part of the bottom segment 58.

5. Flexible Valve Cap

The present disclosure provides a device. FIGS. 6-9 show a dispenser 200. Dispenser 200 includes a container half 212 and a reciprocal container half 214 (hereafter "r-container half"). Container half 212 has an exposed edge 216 and r-container half 214 has a reciprocal exposed edge 218 (hereafter "r-exposed edge"). The container half 212, r-container half 214, exposed edge 216, r-exposed edge 218 may be any respective container half, exposed edge as previously disclosed herein, collectively referred to as "container halves" or "halves." Similarly, the exposed edge 216 and the r-exposed edge 218 may be collectively referred to as "exposed edges," or "edges."

Dispenser 200 includes closure members CC located along exposed edge 216 and reciprocal closure members r-CC (hereafter "r-closure member") located along the r-exposed edge 218. Closure members CC, r-CC may be any respective closure member or reciprocal closure member as previously disclosed herein. In an embodiment, the closure members CC, include protruding member 220 with a hook 224, r-Closure member, r-CC, includes a retaining member 226 having a hole (or indent) 228.

As shown in FIGS. 6-9, each container half 212, 214 has a top portion AA (half 212), r-AA (r-half 214) and a bottom portion BB (half 212) and r-BB (r-half 214). Half 212 includes a cup 230 in top portion AA and r-half 214 includes a reciprocal cup 232 (hereafter "r-cup") in top portion r-AA The cups 230, 232 may by any cup/r-cup as previously disclosed herein.

Figure 6:
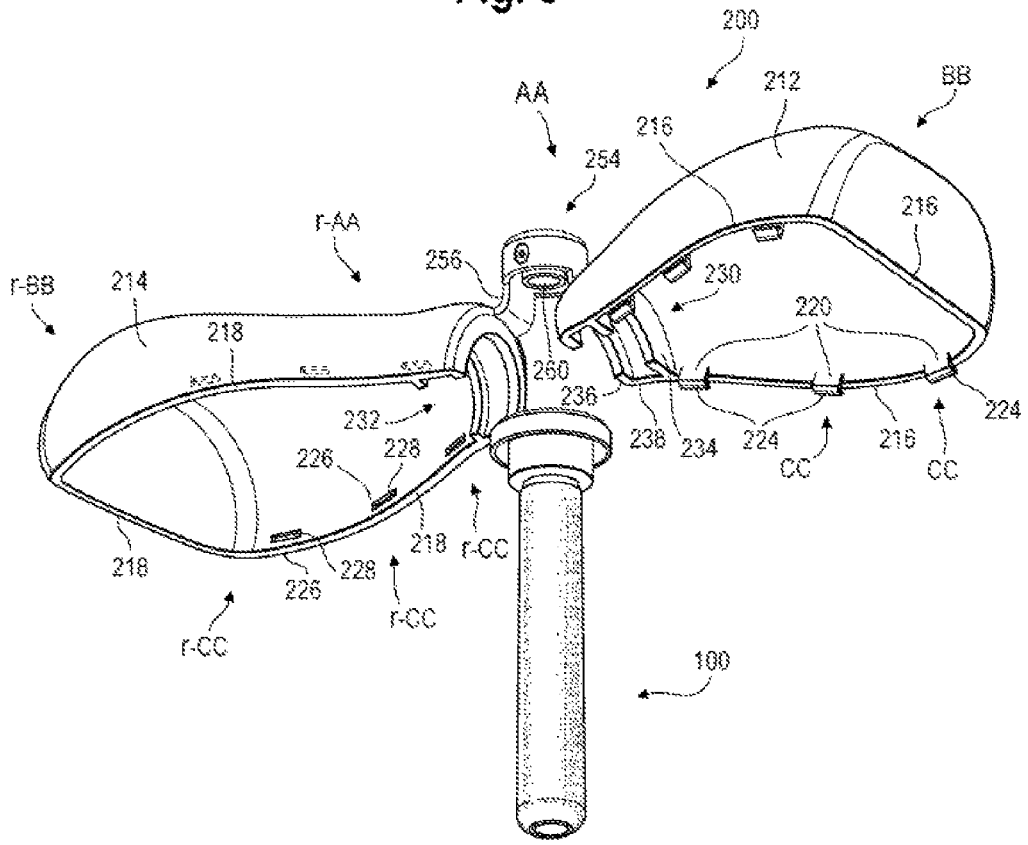
FIG. 6 is a perspective view of an SBoV assembly being inserted into a container half and a reciprocal container half in accordance with an embodiment of the present disclosure.
Figure 7:
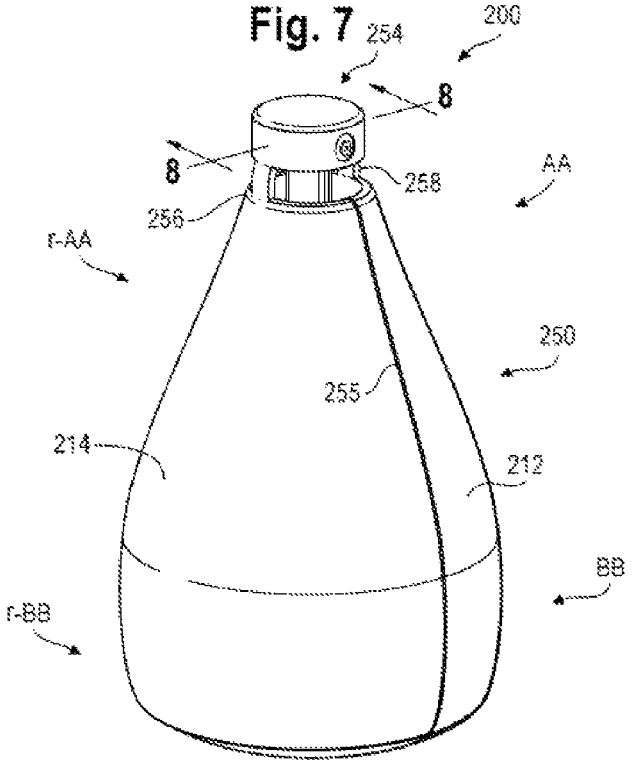
FIG. 7 is a perspective view of a container holding a SBoV assembly in accordance with an embodiment of the present disclosure.
Figure 8:
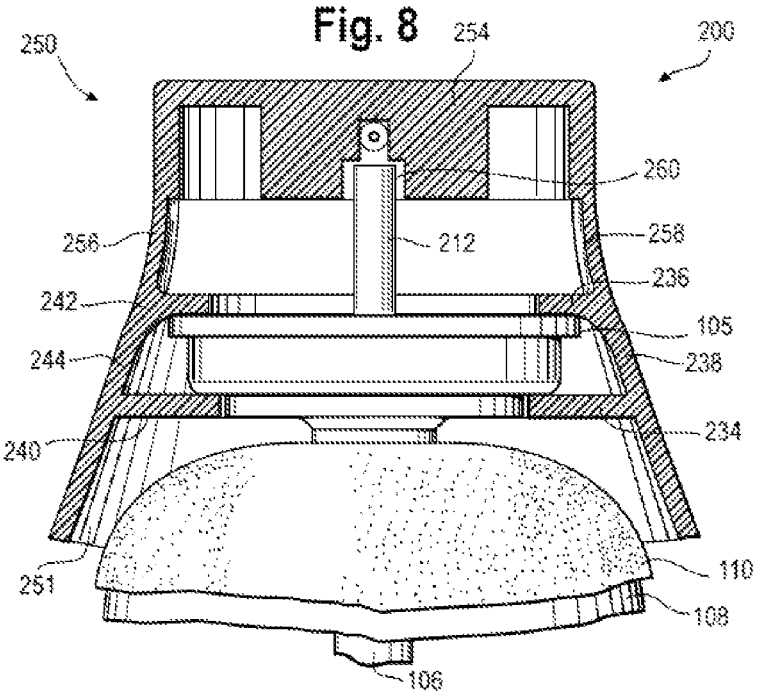
FIG. 8 is a sectional view taken along line 8-8 of FIG. 7.

The dispenser 200 includes a valve cap 254. The valve cap 254 is composed of a polymeric material and includes a first leg 256 and a second leg 258 as shown in FIGS. 6-8. First leg 256 is flexibly attached to the container half 216. The second leg 258 extends from the valve cap on a side opposite the first leg, the second leg 258 flexibly attached to the r-container half 218. The term "flexibly attached," as used herein, refers to structural connection between the valve cap 254 and each half 212, 214 that enables the following movements: (i) hinge movement between the valve cap and each individual half (lateral), (ii) torsional movement (twist) between the valve cap and each half, (iii) compressive movement (flex) between the valve cap and each half, and (iv) any combination of (i)-(III). In other words, the legs 256, 258 enable the valve cap 254 to bend, twist and/or compress with respect to the halves 212, 214. The legs 256, 258 also enable the valve cap 254 to compress (flex) with respect to the valve 112—and with respect to halves 212, 214.

The SBoV 100 is inserted into the cup 230 that is located in half 212. As shown in FIGS. 6, 8, the cup 230 includes a base 234, a shelf 236, and a wall 238 extending between the base 234 and the shelf 236. Similarly r-cup 232 includes a reciprocal base 240 ("r-base"), a reciprocal shelf 242 ("r-shelf"), and a reciprocal wall 244 ("r-wall"). The valve seat 104 is inserted into the cup 230 between the base 234 and the shelf 236. The lip portion 105 is inserted between the shelf 236, and the base 234. The base of cup 230 (and the base or r-cup 232) each has a half collar through which the core tube, bag, and sleeve extend.

The SBoV 100 is placed between the halves 212, 214, with the valve 112 inserted into the interior valve cap 254, as shown in FIGS. 6-8. Valve cap 254 includes a well 260 that receives the valve 212 and provides fluid communication between the valve 212 and the valve cap 254, thereby enabling spray of the fluid material through the valve 112 and out through the valve cap 254, as shown in FIG. 8.

The halves 212, 214 are joined together and closed as previously disclosed. r-Half 214 is joined to half 212 by bringing the r-exposed edge 218 into cooperative contact and placement with exposed edge 216. As the edges 216 and 218 approach each other, the hook 224 comes into contact with the inner surface of r-half, causing the protruding member 220 to flex, or otherwise deflect, radially inward.

Each hook 224 continues its inward motion until the hook 224 mates with its respective retaining member 226 by snapping into the hole (or indent) 228 of its respective retaining member 226. The hook 224 snaps into the hole, bringing exposed edges 216, 218 into full and complete engagement, or contact, with each other. The protruding member 220 is deflected briefly during the joining operation and once the hook 224 mates with its respective retaining member 226, the protruding member 220 returns to a stress-free condition.

When the container 250 is formed, the base of cups 230, 232 support the entire circumference of the valve seat 104. Similarly, the entire circumference of the lip portion 105 is supported between shelves 236, 242 and respective bases 234, 240.

In this way, closures C and reciprocal closures r-C secure the halves 212, 214 to each other to form a whole container (a "container 250") in which the SBoV 100 is securely stationed. Inward motion of the edges 216 and 218 are aligned with, and engage, each other.

Figure 9:
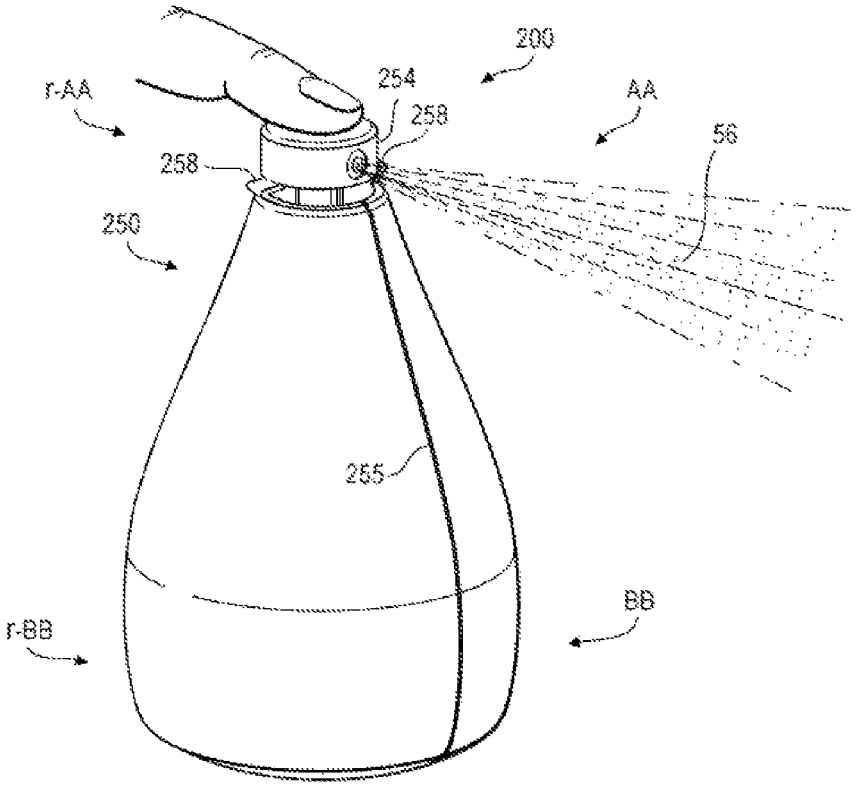
FIG. 9 is a perspective view of a container holding a SBoV assembly dispensing fluid composition in accordance with an embodiment of the present disclosure.

As shown in FIG. 9, first leg 256 and second leg 258 enable pressure (shown by a user's finger) upon the valve cap 254 to flex valve cap 254 downward to actuate the valve and dispense a spray of fluid composition 56.

Applicant's 2-piece snap fit support container for SBoV provides the ability to offer SBoV support containers with myriad container configurations that can be tailored specifically for end use requirements and/or user preferences (ergonomics, aesthetics, etc.).

Definitions and Test Methods

The numerical ranges disclosed herein include all values from, and including, the lower value and the upper value. For ranges containing explicit values (e.g., 1, or 2, or 3 to 5, or 6, or 7) any subrange between any two explicit values is included (e.g., 1 to 2; 2 to 6; 5 to 7; 3 to 7; 5 to 6; etc.).

Unless stated to the contrary, implicit from the context, or customary in the art, all parts and percents are based on weight, and all test methods are current as of the filing date of this disclosure.

The term "composition," as used herein, refers to a mixture of materials which comprise the composition, as cup as reaction products and decomposition products formed from the materials of the composition.

The terms "comprising," "including," "having," and their derivatives, are not intended to exclude the presence of any additional component, step or procedure, whether or not the same is specifically disclosed. In order to avoid any doubt, all compositions claimed through use of the term "comprising" may include any additional additive, adjuvant, or compound, whether polymeric or otherwise, unless stated to the contrary. In contrast, the term, "consisting essentially of" excludes from the scope of any succeeding recitation any other component, step or procedure, excepting those that are not essential to operability. The term "consisting of" excludes any component, step or procedure not specifically delineated or listed.

The term "creep" or "creep rate" is a relaxation characteristic of an elastomeric material. As used herein, "creep" represents the time dependent change in strain while maintaining a constant stress.

Density is measured in accordance with ASTM D 792.

The phrase "elastomeric composite" encompasses also elastomeric nanocomposites, nanocomposites, and nanocomposite compositions. The term "nanofiller" is used in the art collectively to describe nanoparticles useful for making nanocomposites. Such particles can comprise layers or platelet particles (platelets) obtained from particles comprising layers and can be in a stacked, intercalated, or exfoliated state. In some cases, the nanofillers comprise particles of a clay material known in the art as nanoclays (or NCs).

Elongation is determined in accordance with ASTM D 412. Elongation is the extension of a uniform section of a specimen (i.e., an elastomeric composite) expressed as percent of the original length as follows:

$$\text{Elongation } \% = \frac{\text{Final length} - \text{Original length}}{\text{Original length}} \times 100$$

An "ethylene-based polymer," as used herein is a polymer that contains more than 50 mole percent polymerized ethylene monomer (based on the total amount of polymerizable monomers) and, optionally, may contain at least one comonomer.

Melt flow rate (MFR) is measured in accordance with ASTM D 1238, Condition 280° C./2.16 kg (g/10 minutes).

Melt index (MI) is measured in accordance with ASTM D 1238, Condition 190° C./2.16 kg (g/10 minutes).

An "olefin-based polymer," as used herein is a polymer that contains more than 50 mole percent polymerized olefin monomer (based on total amount of polymerizable monomers), and optionally, may contain at least one comonomer. Nonlimiting examples of olefin-based polymer include ethylene-based polymer and propylene-based polymer.

A "polymer" is a compound prepared by polymerizing monomers, whether of the same or a different type, that in polymerized form provide the multiple and/or repeating "units" or "mer units" that make up a polymer. The generic term polymer thus embraces the term homopolymer, usually employed to refer to polymers prepared from only one type of monomer, and the term copolymer, usually employed to refer to polymers prepared from at least two types of monomers. It also embraces all forms of copolymer, e.g., random, block, etc. The terms "ethylene/α-olefin polymer" and "propylene/α-olefin polymer" are indicative of copolymer as described above prepared from polymerizing ethylene or propylene respectively and one or more additional, polymerizable α-olefin monomer. It is noted that although a polymer is often referred to as being "made of" one or more specified monomers, "based on" a specified monomer or monomer type, "containing" a specified monomer content, or the like, in this context the term "monomer" is understood to be referring to the polymerized remnant of the specified monomer and not to the unpolymerized species. In general, polymers herein are referred to has being based on "units" that are the polymerized form of a corresponding monomer.

A "propylene-based polymer" is a polymer that contains more than 50 mole percent polymerized propylene monomer (based on the total amount of polymerizable monomers) and, optionally, may contain at least one comonomer.

As used herein, the term "stress relaxation", which is also used herein simply as "relaxation", describes time dependent change in stress while maintaining a constant strain. Stress of strained elastomeric material decreases with time due to molecular relaxation processes that take place within the elastomer.

Tensile strength and modulus,—"Tensile strength" is a measure of the stiffness of an elastic material, defined as the linear slope of a stress-versus-strain curve in uniaxial tension at low strains in which Hooke's Law is valid. The value represents the maximum tensile stress, in MPa, applied during stretching of an elastomeric composite before its rupture. "Modulus" is a tensile stress of an elastomeric material at a given elongation, namely, the stress required to stretch a uniform section of an elastomeric material to a given elongation. This value represents the functional strength of the composite. M100 is the tensile stress at 100% elongation, M200 is the tensile stress at 200% elongation, etc. Tensile strength and modulus are measured in accordance with ASTM D 412.

Tm or "melting point" as used herein (also referred to as a melting peak in reference to the shape of the plotted DSC curve) is typically measured by the DSC (Differential Scanning Calorimetry) technique for measuring the melting points or peaks of polyolefins as described in U.S. Pat. No. 5,783,638. It should be noted that many blends comprising two or more polyolefins will have more than one melting point or peak, many individual polyolefins will comprise only one melting point or peak.

Some embodiments of the present disclosure will now be described in detail in the following examples.

EXAMPLES

The model for container half 12 hingedly connected to the reciprocal container half 14 as shown in FIGS. 1-5 is designed in a three dimensional (3D) solid modeling software called SolidWorks. The design file is converted to .stl format and uploaded into a 3D printer (STRATASYS Connex machine). The 3D printer slices the model into layers, which it subsequently prints. The 3D printer head lays down sequential layers of acrylic and also shines a light on the acrylic to cure it. The 3D printer then lays down another layer to build the container half 12 hingedly connected to the reciprocal container half 14 as defined in the CAD model. The steps are:

1) design the container half/reciprocal container half in 3D CAD software;
2) convert to .stl format;
3) print the halves on a 3D printer; and
4) clean the support material from the container halves, an artifact of 3D printing.

The completed container half/reciprocal container half each has a nominal wall thickness of 0.1 inches.

A sleeve bag on valve assembly is placed into the container half by inserting the valve seat into the cup of the container half, as shown in FIGS. 2A-2C. The lip portion of the valve seat is supported by the shelf of the container half. The reciprocal container half is then closed upon the container half. Hooks spaced apart along the exposed edges of the container half exposed edge lock into corresponding holes along reciprocal exposed edge of the reciprocal container half, thereby securing the sleeve bag on valve assembly in the interior chamber of the closed container to form the dispenser. The completed dispenser is placed on its base. The dispenser stands upright (valve on top), and stably and rigidly supporting the sleeve bag on valve assembly in a vertical orientation.

It is specifically intended that the present disclosure not be limited to the embodiments and illustrations contained herein, but include modified forms of those embodiments including portions of the embodiments and combinations of elements of different embodiments as come with the scope of the following claims.

The invention claimed is:

1. A dispenser for pressurized material comprising:

a container half having an exposed edge and a closure member at the exposed edge, the container half having a cup half in an interior top portion;

a reciprocal container half having a reciprocal exposed edge and a reciprocal closure member at the reciprocal exposed edge, a reciprocal cup half in an interior top portion;

the closure member and the reciprocal closure member matingly engaged along the exposed edges to attach the container half to the reciprocal container half and form a container;

a sleeve bag on valve (SBoV) assembly in an interior of the container, the SBoV assembly comprising a valve seat; and the cup and the reciprocal cup support the valve seat to secure the SBoV assembly in the container, wherein the cup and the reciprocal cup comprise (i) a shelf and a reciprocal shelf respectively, (ii) a base and a reciprocal base respectively, (iii) a wall and a reciprocal wall respectively, the wall connecting the base and the shelf, and the reciprocal wall connecting the reciprocal base and the reciprocal shelf;

the shelves supporting a lip portion of the valve seat, the lip portion also abutting (i) an inner surface of the container half and (ii) an inner surface of the reciprocal container half; and the bases support the valve seat.

2. The dispenser of claim 1 wherein the SBoV comprises a core tube, the core tube extending below the cups and into an interior chamber of the container.

3. The dispenser of claim 1 wherein the closure member comprises a protruding member matingly engaged with the reciprocal closure member that is a retaining member.

4. The dispenser of claim 1 comprising a hinge member disposed between a portion of the exposed edge and a portion of the reciprocal exposed edge.

5. The dispenser of claim 1 wherein the dispenser is rigid.

6. The dispenser of claim 1 wherein the container half and the reciprocal container half each is composed of a polymeric material.

7. The dispenser of claim 1 wherein the container half and the reciprocal container half each comprises an outer surface with a grip structure.

8. The dispenser of claim 1 wherein wall forms a right angle with the shelf.

9. The dispenser of claim 8 wherein the wall forms a right angle with the base.

10. A process comprising:

providing a container half having an exposed edge and a closure member at the exposed edge, the container half having a cup half in an interior top portion, the cup half having a shelf, a base, and a wall connecting the shelf and the base;

providing a reciprocal container half having a reciprocal exposed edge and a reciprocal closure member at the reciprocal exposed edge, a reciprocal cup half in an interior top portion, the reciprocal cup half having a reciprocal shelf, a reciprocal base, and a reciprocal wall connecting the reciprocal shelf and the reciprocal base;

inserting a sleeve bag on valve (SBoV) assembly in an interior of the container half, the SBoV comprising a valve seat, the valve seat having a lip portion;

joining, with the closure members, the container halves along the exposed edge;

supporting the lip portion with the shelves;

abutting, with the lip portion, (i) an inner surface of the container half and (ii) an inner surface of the reciprocal container half;

supporting the valve seat with the bases; and forming a container with the SBoV in the container interior.

* * * * *